US006843320B2

(12) United States Patent
Yarbro

(10) Patent No.: US 6,843,320 B2
(45) Date of Patent: Jan. 18, 2005

(54) DOWNHOLE TOOL WITH RATCHETING SWIVEL AND METHOD

(75) Inventor: Gregory S. Yarbro, Casper, WY (US)

(73) Assignee: Halliburton Energy Services, Inc., Houston, TX (US)

( * ) Notice: Subject to any disclaimer, the term of this patent is extended or adjusted under 35 U.S.C. 154(b) by 34 days.

(21) Appl. No.: 10/371,254

(22) Filed: Feb. 20, 2003

(65) Prior Publication Data

US 2004/0163810 A1 Aug. 26, 2004

(51) Int. Cl.[7] ..... E21B 43/119

(52) U.S. Cl. ..... 166/297; 166/255.2; 166/55; 166/55.7

(58) Field of Search ..... 166/297, 55, 55.6, 166/55.7, 255.1, 255.2

(56) References Cited

U.S. PATENT DOCUMENTS 3,485,224 A * 12/1969 Ronald ..... 174/109
4,573,536 A * 3/1986 Lawrence ..... 166/373
5,259,466 A * 11/1993 Venditto et al. ..... 175/4.51
6,173,773 B1 * 1/2001 Almaguer et al. ..... 166/255.2

* cited by examiner

*Primary Examiner*—David Bagnell
*Assistant Examiner*—Giovanna Collins
(74) *Attorney, Agent, or Firm*—Browning Bushman

(57) ABSTRACT

A system for perforating a well includes a perforating gun 10 and a swivel 12 suspended from a wireline 50. An orientation sub 14 is provided above the gun 10 and a rotational latching mechanism 90 rotationally connects the wireline to the perforating gun in one direction, while allowing the swivel to rotationally disconnect the gun from the wireline in an opposing direction. According to the method of the invention, the gun may be lowered in the well from the wireline to a depth greater than the desired firing depth until the gun is rotated to its desired azimuthal position, and the gun then raised by the wireline to the desired firing depth with a rotational latching and swivel mechanisms maintaining the gun at its desired azimuthal position.

22 Claims, 2 Drawing Sheets

DOWNHOLE TOOL WITH RATCHETING SWIVEL AND METHOD

FIELD OF INVENTION

The present invention relates to downhole tools, such as a perforating gun, used in hydrocarbon recovery operations to perforate a well. More particularly, this invention relates to a downhole tool with a rotating swivel orientable in the well.

BACKGROUND OF THE INVENTION

Perforating guns have been used for decades to perforate either a cased hole at a desired depth, or to perforate an open hole. In some applications, the perforating gun simply needs to be at the correct depth for the gun to be fired and the well desirably perforated. In other applications, however, the perforating charges located on the perforating gun must be oriented in a desired direction prior to detonation. It is a requirement that the gun be properly oriented prior to detonation in hydraulically fractured wells, and also to electrically sensored or "smart" wells. When hydraulically fracturing a well, injection pressure may be reduced and the flow rates increased if the perforating holes for receiving the charges are correctly aligned with the direction of principal maximum stress. For smart wells, it is important that the gun be properly oriented so that perforating does not injure or destroy the electronic sensors and/or communication lines in the well.

The use of perforating guns in a well has historically also involved the use of a bow spring decentralizer, decentralizing magnets, or offset weight devices. A weight selectively placed on one side of the gun should result in the gun being properly oriented by the weight device against the low side of the well. Decentralizers and decentralizing magnets employ their own system for trying to position a particular side of the gun against the low side of the well. All these devices become less effective when the well has a low angle from vertical. Many systems currently require the well operator to perform an orienting run prior to firing the perforating gun, so that the orientation of the gun with respect to the zone to be perforated may be determined for the run, then this information used to offset the gun to the desired orientation within the well. Orienting runs are commonly analyzed in conjunction with known well survey data in order to provide the required orientation of the gun in a well. These systems incur high costs due to the guidance packages, take valuable time for obtaining the relevant data then orienting the tool in response to that data, then firing the guns. In many applications, the orientation of the gun is "rechecked" by another run after the data has been initially obtained and the tool hopefully oriented to its proper position. The high shock loads caused by firing the gun particularly results in damage to the guidance system.

The disadvantages of the prior art are overcome by the present invention, and an improved perforating gun and method are hereinafter disclosed.

SUMMARY OF THE INVENTION

In one embodiment, the downhole tool is a perforating gun with a ratcheting uni-directional swivel sub. The invention utilizes the unbalanced nature inherent in electromechanical cable and takes advantage of the cable's natural tendency to create a rotational torque.

A system for perforating a well according to this invention includes a perforating gun including one or more perforating charges which are fired to perforate the well. The gun is suspended in the well from a wireline which includes an inner sheath and an outer sheath having different strengths. A swivel is provided for enabling rotation of the perforating gun with respect to a lower end of the wireline, and a rotational latching mechanism, such as a ratcheting mechanism, rotationally locks the perforating gun with the lower end of the wireline in one direction, while allowing the swivel to rotate the lower end of the wireline independent of the gun in an opposing direction. Tension in the wireline thus results in rotational torque to rotate the perforating gun in one direction, and the ratcheting mechanism prevents rotation of the gun in an opposing direction.

In a preferred embodiment, an orientation sub is provided with orientation sensors for determining the azimuthal position of the tool in the well. The wireline includes one or multiple conductors for transmitting signals from the orientation sub to the surface.

It is a feature of the invention that surface equipment, which preferably includes a computer, a display, and an operator input, is provided for receiving signals from the orientation sub, such that the proper orientation of the gun at the desired depth in the well may be determined prior to firing the gun.

Yet another feature of the invention is that the swivel sub may include an inner mandrel, an outer mandrel rotatable with respect to the inner mandrel, and a slip ring assembly for transmitting signals from the orientation sub through the swivel and to the surface. An annulus between the inner mandrel and the outer mandrel may be filled with a selected fluid, and a pressure compensator provided for maintaining a desired pressure differential between the fluid in the annulus and the environment exterior of the swivel sub.

Still a further feature of the invention is that the ratcheting mechanism may include a gear and pawl assembly. In a preferred embodiment, a gear with plurality of circumferentially spaced teeth is provided on an inner mandrel of the swivel sub, and a pawl for engaging the teeth is mounted on an outer mandrel. The pawl and gear assembly allow rotation of the inner mandrel in one direction relative to the outer mandrel, but prohibit rotation of the inner mandrel relative to the outer mandrel in an opposing direction.

According to the method of the invention, the orientable tool, such as a perforating gun, may be lowered in a well from a wireline to a depth lower than the desired perforation depth. As the gun is raised and lowered past the perforation depth, the orientation sub monitors the azimuthal position of the gun within the well. As the gun is raised and lowered, changes in tension in the wireline rotate the gun in one direction. Once the orientation sub determines that the gun is at the proper azimuthal position, the wireline is pulled upward, thereby raising the gun to the desired perforation depth. As the gun is pulled upward in the well, it is rotationally separated from the end of the wireline due to the ratcheting mechanism. When at the proper depth and the desired orientation, as verified by the orientation sub, the gun may then be fired.

A significant advantage of the present invention is that a highly reliable system for perforating a well does not include complex and expensive components. To the contrary, the individual components of the system have been proven to be highly reliable in downhole operations.

These and further objects, features and advantages of the present invention will become apparent from the following detailed description, wherein reference is made to the figures in the accompanying drawings.

DETAILED DESCRIPTION OF PREFERRED EMBODIMENTS

Figure 1:
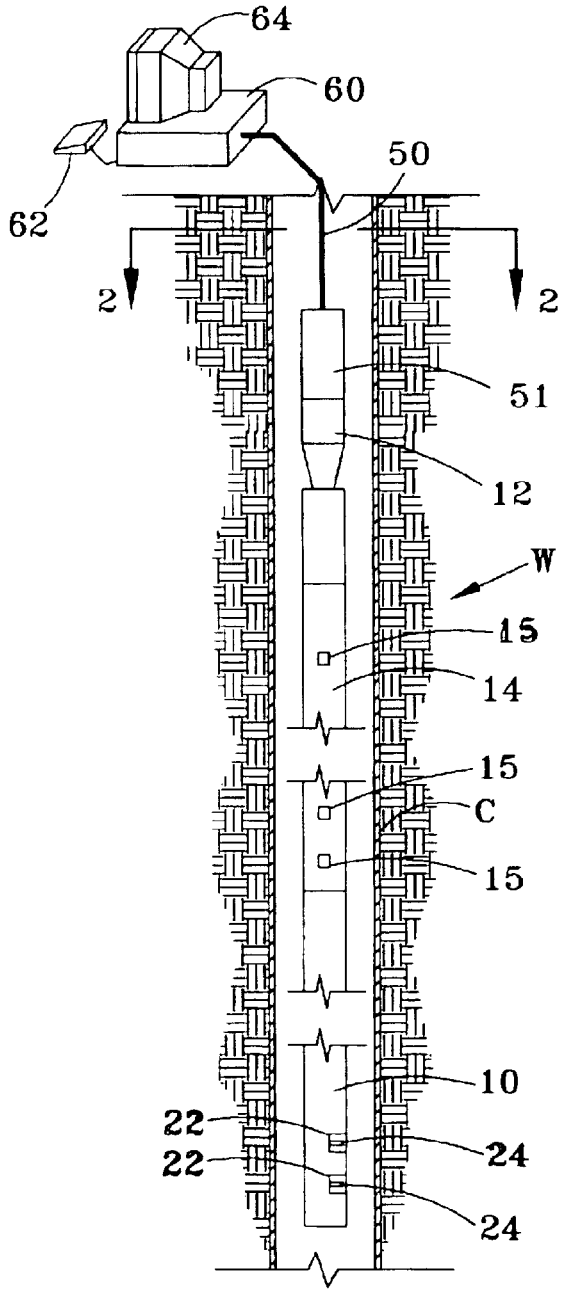
FIG. 1 generally illustrates a perforating gun according to the present invention suspended in a well from the wireline or cable.

FIG. 1 generally illustrates a perforating tool or gun 10 according to the present invention suspended in a well W including a casing C from wireline or cable 50. The gun 10 includes one or more cavities or pockets 22 each receiving a firing charge 24 to penetrate the well when the gun is fired.

Above the gun is positioned an orientation sub 14, a swivel sub 12, and a head 51, with an upper end of each component connected to a lower end of the upper component. The head 51 connects the wireline 50 to the gun assembly for suspending the gun 10 in the well. A single or multi-conductor cable head 51 for transmitting electrical and/or optical signals, and for transmitting mechanical integrity, may thus be attached to the swivel sub 12. The orientation sub 14 is capable of detecting the azimuthal orientation of the downhole assembly, and includes one or more sensors 15 for generating signals indicative of azimuthal position and is connected to the perforating gun 10 that is to be oriented. The orientation sub 14 may house any number of conventional guidance system technologies, including conventional gyros, rate gyros, optical gyros, inertia systems, accelerometers, magnetometers, and low-side/high-side sensing systems. In still other embodiments, sensors on the orientation sub 14 may be responsive to a smart package system in a well which may include triggers, sensor triggers, or transmitters in the well, so that wireline 8 may be used to transmit smart well data to surface equipment to analyze the data and determine when the tool is properly oriented.

Figure 2:
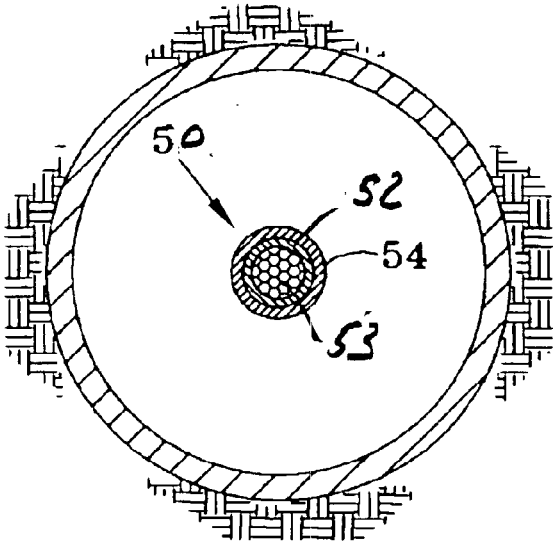
FIG. 2 is a cross-section of the well as shown in FIG. 1, illustrating the inner and outer sheaths of the cable.

The electromagnetic cable 50 as shown in FIG. 2, which is of the type commonly utilized to perforate hydrocarbon recovery wells, is "unbalanced". The unbalanced nature of this cable is created by the unequal strengths of the inner armor or sheath 52 and the outer armor or sheath 54 of the cable 50. FIG. 2 also shows a plurality of conductor 53 radially within inner sheath 52. The cable head 51 is used to secure the tool(s) lowered into the well from the lower end of the cable. As tension is altered in the cable, rotational torque is developed that causes any device attached to the cable, such as perforating gun 10, to rotate. As the gun 10 is lowered and then removed from the well, the cable 50 experiences changes in tension, and the reactionary forces are then transmitting to the gun. If not prevented from rotating by a swivel sub, the gun 10 will rotate in one direction while going in the hole, and will rotate in the opposite direction when being retrieved from the hole.

Figure 4:
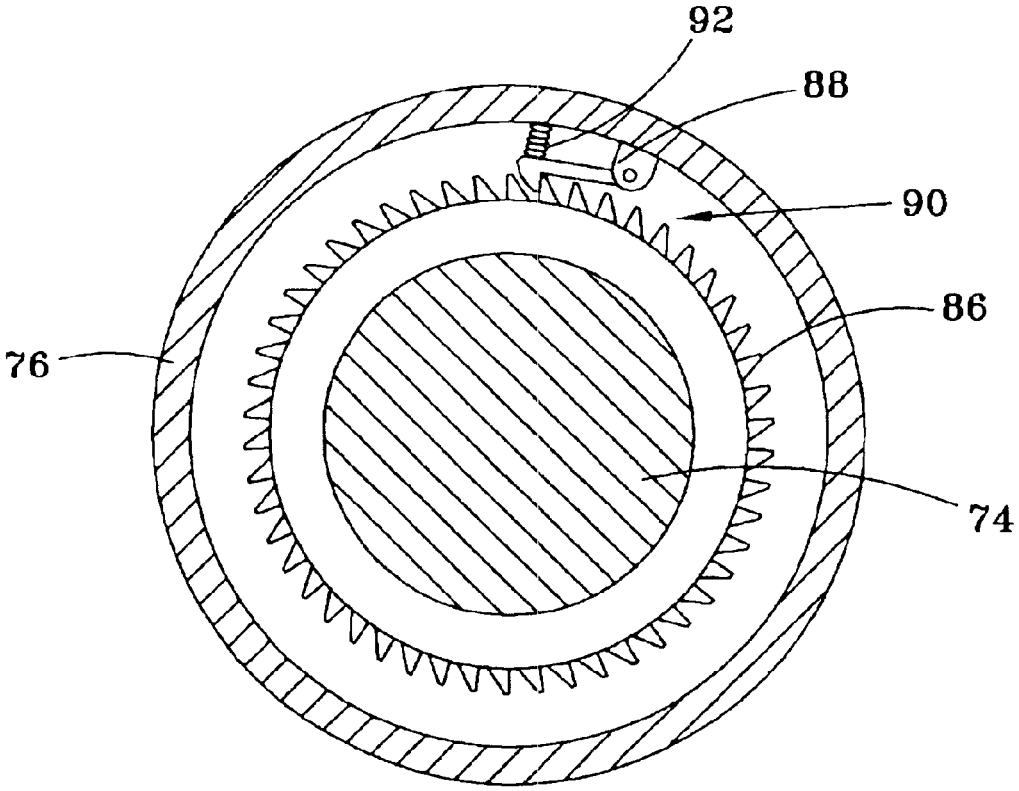
FIG. 4 is a simplified cross-sectional view of a suitable ratcheting mechanism which may be positioned within the swivel sub.

The swivel sub 12 according to the present invention includes a ratcheting mechanism 90 as shown in FIG. 4 which causes the gun 10 to rotate in only one direction, while being rotationally free from line torque of cable 50 in the opposite direction. The ratcheting mechanism 90 thus allows the gun to rotate while being deployed into the hole. Gun orientation may be measured and displayed at the surface on real time display 64, and may be input to computer 60 with operator input 62. The gun may be pulled up to the correct depth, with the gun properly oriented. While the gun 10 is being pulled upward, the ratcheting mechanism 90 allows for the swivel sub 12 to rotate, so that line torque from cable 50 is not applied to the gun 10.

Figure 3:
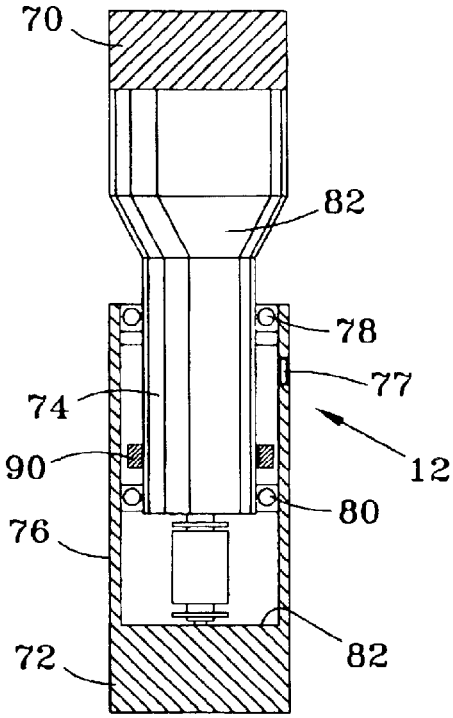
FIG. 3 is a simplified side view, partially in a cross-section, of the swivel generally shown in FIG. 1.

The swivel sub 12 as shown in FIG. 3 includes upper and lower electrical conductor blocks 70, 72 which connect mechanically and electronically to equipment above and below the swivel sub. These conductor blocks may have either single or multi-conductor cable capability. An inner mandrel 74 secured to block 70 is inserted into another mandrel 76 secured to block 72. Bearing and seal assembly 78, 80 allow for free rotation within the inner mandrel with respect to the outer mandrel. The chamber within the swivel sub 12 is preferably filled with oil, and the internal pressure is maintained as equivalent value as the hydrostatic pressure encountered in the wellbore by compensation device 77. This pressure balance system allows for free operation of the bearing mechanism. A slip ring assembly 82 consists of brushes, and contacts provide a rotating electrical connection between conductor blocks 70 and 72.

A toothed gear and pawl ratcheting mechanism 90 as shown in FIG. 4 provides the desired ratcheting function. The gear and pawl assembly may be configured for ratcheting in either direction of rotation. The mechanism 90 includes a tooth gear 86 securely mounted to the inner mandrel 74. A pawl mechanism 88 is mounted to the outer mandrel 76, and is maintained in contact with the tooth gear by a spring 92 or other biasing device.

The swivel sub 12 of the present invention may include a ratcheting mechanism which may be employed in either direction, thus allowing a "free will" condition during either the deployment or retrieval of the gun. The direction of rotational force applied to the gun may be selected by the configuration of the ratcheting mechanism. Orientation of the gun 10 may be achieved in either the upward or downward movement of the electromechanical cable 50, then the gun maintained in that orientation while moving axially to the correct firing depth in the well. Once the gun is pointed in the desired position, the gun may be raised or lowered in the well to the correct firing depth, with that operation resulting in rotation of the lower end of the cable due to the varying strengths of the sheaths, but the swivel allows the end of the cable to rotate independent of the orientation of the gun, so that the gun desirably maintains its orientation when moved to the desired firing depth. When being raised or lowered to the firing depth, it is possible that the "free wheeling" gun may bump the side of the borehole, in which case the gun may rotate. When at the desired firing depth, however, the proper position of the gun may be checked by the orientation sub and, if the gun has undesirably rotated to become out of alignment with its selected position, the gun may again be lowered or raised in the well to a position wherein the gun is properly oriented, then the gun moved axially to the desired firing depth. When the gun is at its desired depth and the desired orientation of the gun is confirmed by the orientation sub, the gun may be fired.

It should be understood that a change in the depth of the gun in a well will tend to rotate the gun, but that the forces which cause that rotation are not directly a function of the depth of the gun, but more properly a function of the changed tension in the cable. When lowering a gun in a well at a given depth, the tension in the cable will thus be different then when raising the gun in the same well at the same depth. Accordingly, the action of lowering or raising the gun changes the torsional forces at the lower end of the cable which may be selectively transmitted or is rotationally separated from the gun, and those changing forces are affected by the depth of the gun in the well, whether the gun is being raised or lowered at that depth, and possibly the speed at which the gun is moving in the well at that depth.

A preferred embodiment of the invention as discussed above includes a ratcheting mechanism which rotationally locks the gun in one direction with respect to the lower end of the cable while allowing the swivel to rotationally disconnect the gun in an opposing direction from the lower end of the cable, such that a change in tension in the wireline results in rotational torque to rotate the gun in the well, while the ratcheting mechanism rotationally disconnects the gun from the lower end of the cable in the opposing direction. A ratcheting mechanism is a preferred type of a rotational latching mechanism for accomplishing this purpose, although various rotational latching mechanisms other than a ratcheting mechanism may serve this purpose. In this sense, the invention provides a form of a controllable or selectable swivel sub which normally allows rotation, but which can be rotationally unlatched such that the rotational forces at the end of the cable are disconnected or "free wheeling" from the gun. The ability to lock the swivel sub and thereby eliminate the ability of the sub to swivel causes the rotational forces developed in the cable to act on the perforating gun, rotating the gun. The invention also provides the ability to "unlock" the swivel, such that once the desired gun orientation is achieved, the swivel is "unlocked" and the rotational forces developed in the cable are prevented from affecting the perforating gun orientation due to the rotation at the swivel.

Another technique for controlling the swivel sub would be through an electromagnetic mechanism, such as an electro solenoid, which is another form of a rotational latching mechanism. The solenoid may activate a locking pin that may mate with equally spaced holes or slots on the inner or outer mandrel of the swivel sub. When the solenoid is activated, the swivel sub would be prevented from swiveling. An option to the locking pin may be that the solenoid may activate a brake system, such as a caliper/disk arrangement, to prevent the swivel function. Alternatively, an inner and outer mandrel of the swivel may be rotatably locked without employing moving parts, e.g., using electromagnets. Energizing an electromagnet pair or a single electromagnet coupled to a permanent magnet may generate sufficient force to effect a rotational lock between the inner and outer mandrel. The solenoid or other electrical device may be controlled by a directional rotation sensor in the swivel, or controlled from surface via the electromechanical logging cable.

It may also be possible to lock and unlock the swivel sub by controlling a locking pin or caliper/disk brake system activated by altering the hydrostatic well pressure. By increasing or decreasing the pressure at the surface, the resultant hydrostatic pressure experienced at the tool is altered. Sensors located in the swivel sub may then activate or deactivate the pin, brake or other mechanism to lock and unlock the swivel sub.

Other mechanical techniques may be employed that may rely on the direction of rotation or the differences in tension experienced at the swivel sub when altering direction of movement. Existing oil field devices utilize sliding sleeves and/or slotted mechanism, such as "J" slots or "W" slots, to achieve down hole mechanical actions. Such mechanical movements may be employed to lock and unlock the swivel action of the swivel sub as the direction of travel is reversed. Likewise, numerous techniques may be used that, like the ratcheting mechanism described, lock the inner and outer mandrel depending on their relative direction of rotation. A rotational latching mechanism may employ offset cams that act as a brake in one direction, but allow slipping in the opposite direction. Mechanical linkages may engage or disengage a locking pin, depending on relative rotation.

Logging tools commonly used for either fluid or formation testing may benefit by orienting the logging tool or sampling device in relation to the anisotropic distribution of the formation properties. Suitable logging tools orientatable in a well according to this invention include an explosive sidewall core sampling tool, a rotary sidewall core sampling tool, and a hydraulically operated fluid sampling device. Suitable tools may include pad mounted density logging tools, pad mounted neutron logging tools and pad mounted micro-resistivity logging tools. Various pad mounted sensors in the logging tool may be oriented prior to beginning the logging pass to either reduce borehole effects or overcome limitations of the pad deployment. The logging tool may thus be oriented in the well at the desired azimuthal position and the desired depth by the techniques of the present invention.

As discussed above, the equipment and techniques of the present invention are well suited for properly orienting a gun in a well. It should be appreciated, however, that various downhole tools other than guns may similarly be oriented in a well by providing an orientation sub for determining the azimuthal position of the tool, and then pulling the tool upward on the wireline to the desired position while the rotational latching mechanism rotationally disconnects the tool from the lower end of the wireline. Tools other than perforating guns, logging tools or sampling devices may also be beneficially oriented at selected depths when the action or measurements of the tool are orientably dependent.

While preferred embodiments of the present invention have been illustrated in detail, it should then be apparent that other modifications and adaptations of the preferred embodiments will occur to those skilled in the art. However, it is to be expressly understood that such modifications and adaptations are within the spirit and scope of the present invention as set forth in the following claims.

What is claimed is:

1. A system for perforating a well, comprising:

a perforating gun including one or more perforating charges for firing to perforate the well;

a wireline for suspending the perforating gun in the well, the wireline including an inner sheath with an inner sheath strength and an outer sheath with an outer sheath strength differing from the inner sheath strength;

a swivel for enabling rotation with the perforating gun with respect to a lower end of the wireline; and a rotational latching mechanism for rotating the perforating gun with the lower end of the wireline in one direction, while rotationally separating the gun from the lower end of the wireline in an opposing direction, such that tension in the wireline results in rotational torque to rotate the gun in the well, and the rotational latching mechanism separates the rotational torque from the gun in the opposing direction.

2. The system as defined in claim 1, further comprising:

an orientation sub suspended in the well with the perforating gun and including a plurality of sensors by determining the azimuthal position of the gun in the well.

3. A system as defined in claim 2, wherein the wireline includes one or more conductors for transmitting signals from the orientation sub to the surface.

4. A system as defined in claim 3, further comprising:

surface equipment responsive to signals from the orientation sub, the surface equipment including a computer and a display.

5. A system as defined in claim 1, wherein the swivel further comprises:

an inner mandrel;

an outer mandrel rotatable relative to the inner mandrel; and a slip ring assembly for transmitting signals between the inner mandrel and the outer mandrel.

6. A system as defined in claim 5, further comprising:

a pressure compensator for maintaining a desired pressure in an annulus between the inner mandrel and the outer mandrel relative to the environment external of the swivel.

7. A system as defined in claim 1, wherein the rotational latching mechanism includes a ratcheting mechanism.

8. A system as defined in claim 7, wherein the ratcheting mechanism includes a gear and pawl assembly.

9. A system as defined in claim 8, wherein the gear and pawl assembly includes a gear secured to an inner mandrel of the swivel, and a pawl mounted on an outer mandrel of the swivel.

10. A system as defined in claim 9, wherein the gear and pawl assembly includes a biasing member for biasing the pawl toward the gear.

11. A system as defined in claim 7, wherein the swivel includes a swivel sub, and the ratcheting mechanism is housed within the swivel sub.

12. A system for positioning a tool in a well, comprising:

a wireline for suspending the tool in the well, the wireline including an inner sheath with an inner sheath strength and an outer sheath with an outer sheath strength differing from the inner sheath strength;

an orientation sub secured to the tool, the orientation sub including a plurality of sensors by determining the azimuthal position of the tool in the well;

a swivel for enabling rotation with the tool with respect to a lower end of the wireline;

a rotational latching mechanism for rotating the perforating gun with the lower end of the wireline in one direction, while rotationally separating the gun from the lower end of the wireline in an opposing direction, such that tension in the wireline results in rotational torque to rotate the gun in the well, and the rotational latching mechanism separates the rotational torque from the gun in the opposing direction; and surface equipment responsive to signals from the orientation sub, the surface equipment including a computer and a display.

13. A system as defined in claim 12, wherein the wireline includes one or more conductors for transmitting signals from the orientation sub to the surface.

14. A system as defined in claim 12, wherein the swivel further comprises:

an inner mandrel;

an outer mandrel rotatable relative to the inner mandrel; and a slip ring assembly for transmitting signals between the inner mandrel and the outer mandrel.

15. A system as defined in claim 12, wherein the rotational latching mechanism includes a ratcheting mechanism.

16. A system as defined in claim 15, wherein the ratcheting mechanism includes a gear and pawl assembly.

17. A method of positioning a tool in a well, comprising:

lowering the tool from a wireline into the well, the wireline including an inner sheath with an inner sheath strength and an outer sheath with an outer sheath strength differing from the inner sheath strength;

providing a swivel for rotating the tool with respect to a lower end of the wireline;

providing a rotational latching mechanism for rotating the tool with a lower end of the wireline in one direction, while rotationally separating the tool from the lower end of the wireline in an opposing direction;

positioning the tool, the swivel, and the rotational latching mechanism at a depth in the well until varying tension in the wireline results in the tool being rotated to a desired azimuthal position; and thereafter axially moving the tool in the well with the wireline to the desired depth, with the rotational latching mechanism rotationally disconnecting the tool from the wireline as the tool moves in the well to the desired depth.

18. A method as defined in claim 17, further comprising:

providing an orientation sub for determining the azimuthal position of the tool in the well; and transmitting signals from the orientation sub to the surface through conductors in the wireline.

19. A method as defined in claim 18, further comprising:

confirming the azimuthal position of the tool in the well while at the desired depth.

20. A method as defined in claim 17, wherein providing the swivel comprises:

providing an inner mandrel rotatable relative to an outer mandrel; and providing a slip ring assembly for transmitting signals between the inner mandrel and the outer mandrel.

21. A method as defined in claim 20, further comprising:

providing a pressure compensator for maintaining a desired pressure differential between fluid and an annulus between an inner and the outer mandrel and the environment exterior of the swivel.

22. A method as defined in claim 17, wherein providing the rotational latching mechanism comprises:

mounting a gear on an inner mandrel of the swivel; and mounting a pawl on an outer mandrel of the swivel, such that teeth on the gear cooperate with the pawl to rotate the tool in one direction.

* * * * *